United States Patent [19]

Thomas et al.

[11] Patent Number: 5,050,861

[45] Date of Patent: Sep. 24, 1991

[54] ADJUSTABLE BENCH-STEP

[76] Inventors: Laurie Thomas, 442 Hunter Dr., Carol Stream, Ill. 60188; Robert W. Nicholas, 8606 Main St., Downers Grove, Ill. 60506

[21] Appl. No.: 628,183

[22] Filed: Dec. 14, 1990

[51] Int. Cl.[5] ..... A63B 23/04; F16M 11/00; A47B 57/34; A47B 9/00

[52] U.S. Cl. ..... 272/70; 108/19; 108/96; 108/107; 248/149; 248/157

[58] Field of Search ..... 297/438, 439, 461, 462; 272/70; 108/12, 19, 96, 107; 182/33; 248/149, 151, 157, 188.2, 912

[56] References Cited

U.S. PATENT DOCUMENTS

| | | | |
|---|---|---|---|
| 2,527,505 | 10/1950 | Wilkinson, Jr. . | |
| 2,599,020 | 6/1952 | Safstrom | 108/144 |
| 2,619,154 | 11/1952 | Erickson | 297/461 |
| 2,809,875 | 10/1957 | Diack . | |
| 2,850,081 | 9/1958 | Dillon | 297/462 |
| 3,743,283 | 7/1973 | Garrett . | |
| 3,904,158 | 9/1975 | Michael | 248/149 |
| 4,237,795 | 12/1980 | Parker | 108/19 |
| 4,301,745 | 11/1981 | Dale . | |
| 4,340,218 | 7/1982 | Wilkinson . | |
| 4,453,472 | 6/1984 | Ward | 108/107 |
| 4,624,341 | 11/1986 | Lee | 297/461 |
| 4,648,593 | 3/1987 | Wilkinson . | |
| 4,903,614 | 2/1990 | Johnson | 108/19 |

FOREIGN PATENT DOCUMENTS

| | | | |
|---|---|---|---|
| 124432 | 10/1901 | Fed. Rep. of Germany | 248/188.2 |
| FR2611508 | 9/1988 | France . | |
| SU1227210 | 4/1986 | U.S.S.R. . | |

OTHER PUBLICATIONS

The Latest Hassocks Have Storage Space, Popular Mechanics, May 1938, pp. 771–773.

*Primary Examiner*—Richard J. Apley
*Assistant Examiner*—Karen G. Horowitz
*Attorney, Agent, or Firm*—Niro, Scavone, Haller & Niro

[57] ABSTRACT

An adjustable bench-step for use in exercising, having an upper platform that is easily and securely insertable into a base, with the upper platform further being both adjustable vertically and approachable from any horizontal axis.

5 Claims, 2 Drawing Sheets

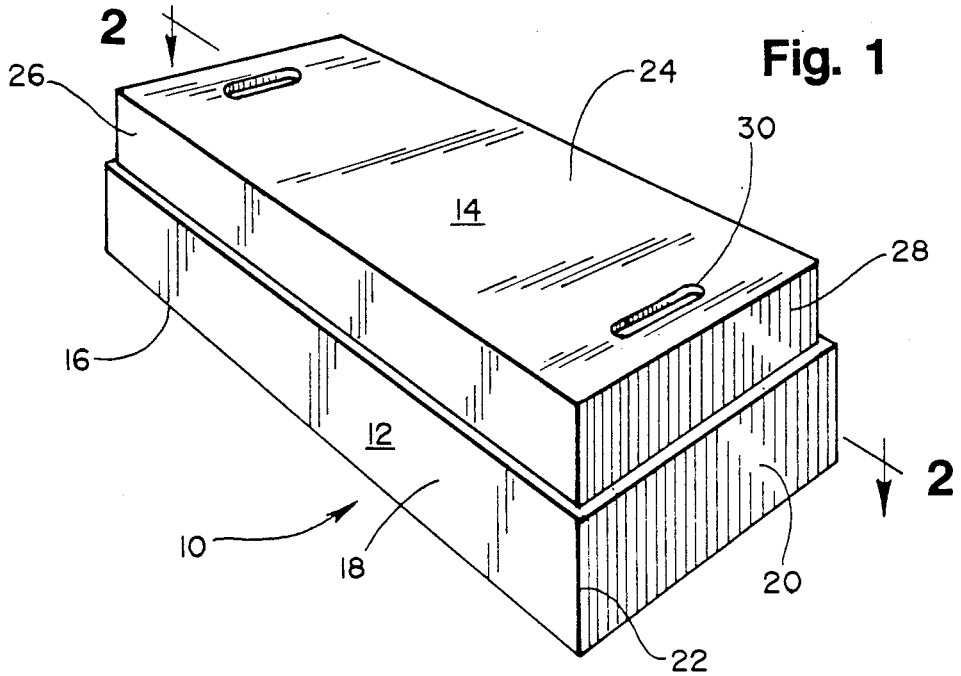
Fig. 1
Fig. 2
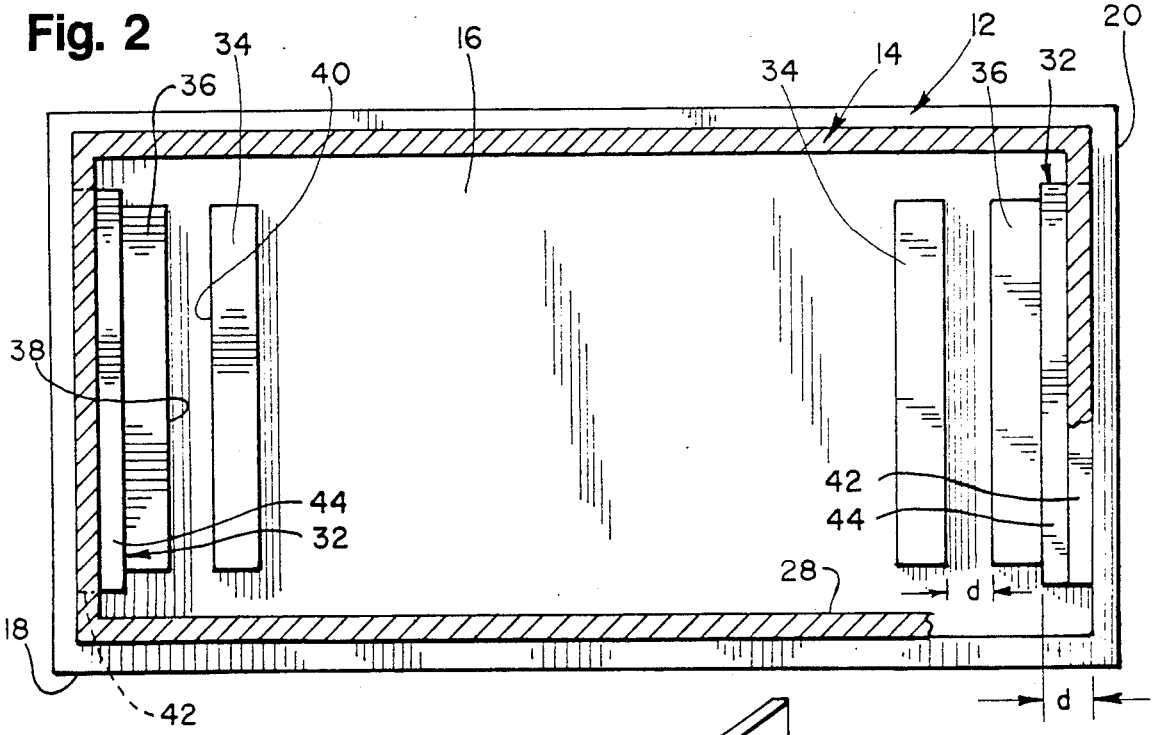
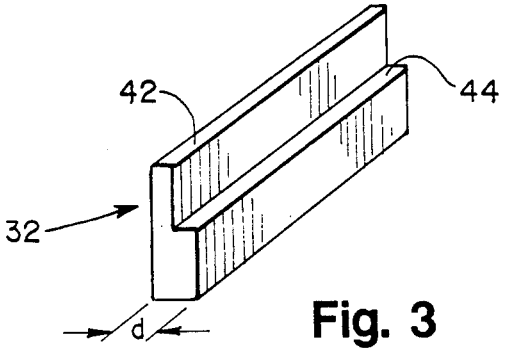
Fig. 3

ADJUSTABLE BENCH-STEP

BACKGROUND OF THE INVENTION

The present invention relates to an exercise device and, more particularly, to an adjustable bench-step for use in aerobic exercise, step training or benching.

Over the past decade, millions of people have participated in high-impact aerobic training. However, continued participation in high-impact aerobic training can cause extensive damage to the hip, knee and ankle joints as well as other portions of the human body. The recent advent of step benching or "benching" has become a viable, low-impact alternative to high-impact aerobics.

The art of benching includes elements from aerobic exercise, stair-climbing and running. The participant must coordinate his hands and feet to the beat of accompanying music as he steps up and down from the bench-step. The practice of benching permits the participant to obtain a level of fitness equivalent to that obtained through high-impact aerobics, without incurring excessive wear and tear on the participant's body.

The practice of benching, of course, requires a bench-step device. The original bench-step consisted of milk crates. However, these early step devices lacked vertical height adjustability. The elevation of the bench-step determines the degree of difficulty of the step aerobics. Thus, the higher the vertical elevation of the step, the more strenuous the exercise. Additionally, the prior art devices that had an adjustable vertical height could only be utilized along one axis and were not easily transportable.

For example, U.S. Pat. No. 3,743,283 to Garret, and U.S. Pat. No. 4,648,593 to Wilkinson, disclose adjustable height step-climbing exercising equipment. However, each device limits the participant to step or climb onto the device along only one axis. Furthermore, neither device includes a storage area, and only the Wilkinson patent is transportable. Another example of a known device is shown in U.S. Pat. No. 4,340,218 to Wilkinson, which discloses a resilient-type exerciser for simulating climbing. But the '218 patent discloses a device which only permits the user to climb onto the machine along one axis. Further, the invention teaches that the user attach a restraining mechanism to his ankles. Also, that device utilizes pins or rods, inserted through holes in the support frame to control the vertical height of the stepping platform. Nor is the Wilkinson device easily transportable. U.S. Pat. No. 2,599,020 to Saftrom, and U.S. Pat. No. 4,106,413 to Hoaglund, disclose adjustable tables. However, neither table would be sufficiently stable to be used during the practice of benching. Also, neither table is easily transportable, nor does either contain a storage compartment. Finally, no known prior art device discloses a device for raising the vertical height of the step in a fashion similar to this invention.

SUMMARY OF INVENTION

The present invention overcomes the problems presently encountered in the practice of the exercise termed "benching". The present invention utilizes supports or stops which are placed in various positions. The vertical elevation of the bench-step differs in accordance with the position of the supports or stops. An increase in the vertical height of the step increases the difficulty of the exercise.

Therefore, an object of the present invention is to provide a device for use in benching having a plurality of easily adjustable vertical elevations.

Another object of the present invention is to provide an adjustable bench-step which is approachable from any direction.

Yet another object of the present invention is to provide an adjustable bench-step which can be conveniently transported and stored.

A further object of the present invention is to provide a adjustable bench-step which includes a convenient storage compartment usable both during exercise and during transportation or storage.

Still another object of the present invention is to provide a stable and durable bench-step device..

BRIEF DESCRIPTION OF THE DRAWINGS

Further objects, advancements and embodiments of the present invention, together with the manner of operation, will become apparent from the following detailed description and drawings, he several views.

FIG. 1 is a perspective view of the complete bench-step with the step platform adjusted to the uppermost vertical height setting;

FIG. 2 is a plan view of the invention, taken along line 2—2, demonstrating all of the working components;

FIG. 3 is a side perspective view of the L-shaped rest;

DETAILED DESCRIPTION OF THE PREFERRED EMBODIMENTS

Figure 4:
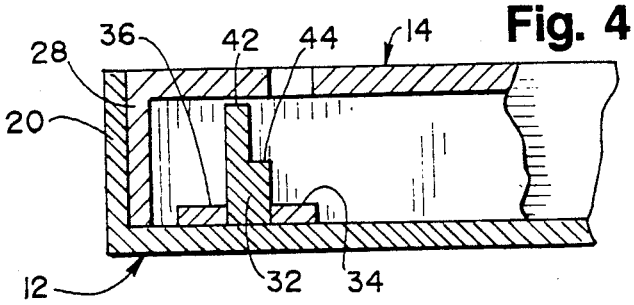
FIG. 4 is a side perspective view of the bench-step in the lowermost or closed position.

The adjustable bench-step of the present invention is shown generally as 10 in FIG. 1. The adjustable bench-step 10 includes a base 12 and an upper platform 14. The base 12 includes a base floor 16, two parallel longitudinal base walls 18, and two parallel transverse base walls 20. The longitudinal base walls 18 are adjoined to the transverse base walls 20 along corner 22 by glue nails or other similar fastening devices. The base floor 16 is adjoined to the transverse base walls 18 and longitudinal 20 base walls in a similar fashion. The upper platform 14 consists of step surface 24, which runs parallel with the base floor 16. Step surface 24 is supported, and adjoined thereto, to two parallel longitudinal upper platform walls 6 and two parallel transverse upper platform walls 28 which together form a downwardly extending apron. The inner perimeter formed by the longitudinal base walls 18 and the transverse base walls 20 is greater than the outer perimeter formed by the longitudinal upper platform walls 26 and the transverse upper platform walls 28. The dimensions are such that the upper platform 14 may be inserted into and easily removed from the base 12. The support platform 14 contains two substantially elliptical holes 30 cut into the step platform 24 to permit the user to grip the upper platform 24 during removal of the upper step surface 14 from the base 12. Of course, the holes can be formed into any shape suitable for grasping. The entire bench-step 10 may be constructed of wood, metal, plastic or any other suitably durable material. The bench-step may also be padded, as with foam or rubber, as well.

FIG. 2 illustrates the internal working of the bench-step base 12 and the devices used to vary the platform height. The base floor 16, as well as the longitudinal base walls 18 and each of the transverse base walls 20, are displayed. Referring now to FIG. 2, a vertical L-shaped rest 32 is used to adjust the vertical height of the upper platform 14. This L-shaped rest 32 is slidably inserted and removable. Two inner restraining stops 34 are identical in size and shape to the two outer restraining stops 36. Both the outer 36 and inner 34 restraining stops are secured to the base floor 16, such that the outer restraining stop 36 is nearest the transverse base wall 20. Both the inner restraining stops 34 and the outer restraining stops 36 run parallel to the transverse base wall 20.

Referring now to FIG. 2, the distance "d" between the transverse base wall 20 and the edge of the outer restraining stop 36 is substantially equivalent to the width of the L-shaped support 32. Thus, the L-shaped support 32 may be easily and slidably inserted between the transverse base wall 20 and the restraining stop 36, forming a snug fit.

The L-shaped support 32 may alternatively be positioned between the inner restraining stop 34 and the outer restraining stop 36. The distance between the inner edge 38 of the outer restraining stop 36 and the outer edge 4 of the inner restraining stop 34 is again the same distance "d." Since the width of the L-shaped support 32 is approximately equal to the distance "d," the L-shaped support 32 ma be snugly positioned between the outer restraining stop 34 and the inner restraining stop 36.

Referring now to FIG. 3, the L-shaped support 32 includes an upper ledge 42 and a lower ledge 44. The L-shaped support 32 may be constructed of wood, metal, plastic or any other suitably durable material. The width of lower ledge 44, as viewed in cross-section along the longitudinal axis of L-shaped support 32, is substantially equivalent to the thickness of transverse upper platform walls 28. As will now be seen, the L-shaped support 32 controls the vertical height of upper platform 14.

Figure 5:
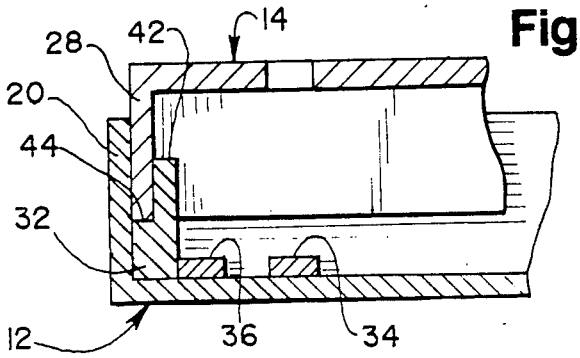
FIG. 5 is cross-sectional side view of the bench-step in the intermediate position.
Figure 6:
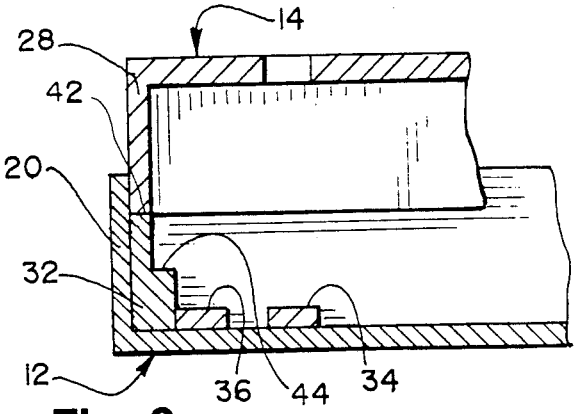
FIG. 6 is a cross-sectional side view of the bench-step in the uppermost or highest position.
Figure 8:
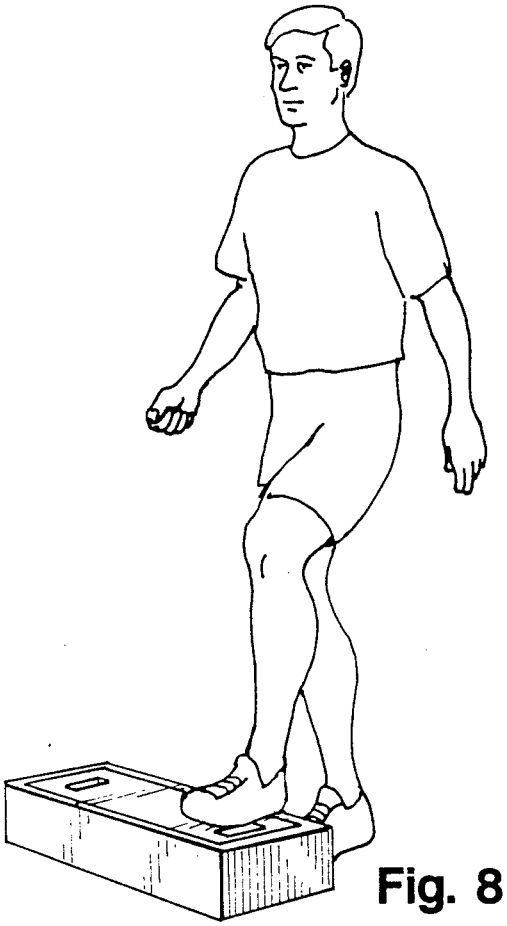
FIG. 8 is a perspective view of the invention as used in practice.
Figure 7:
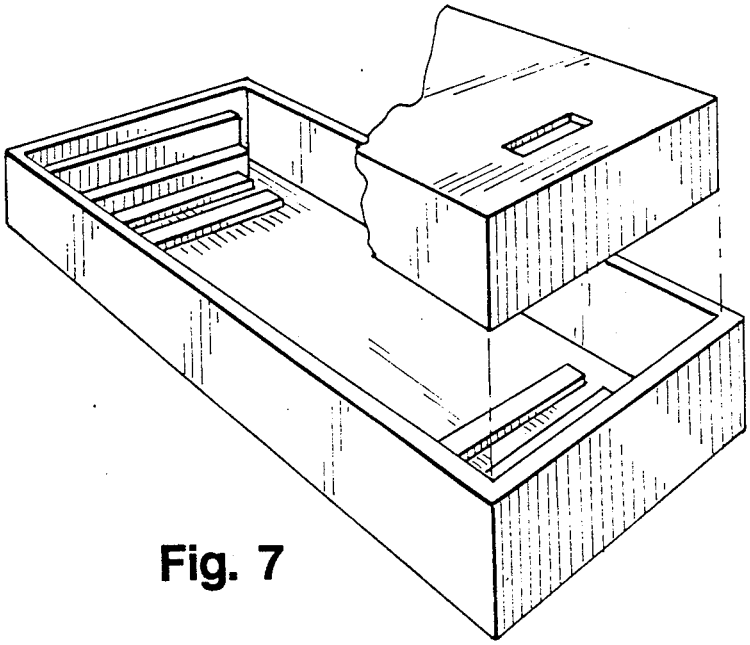
FIG. 7 is a generally planar view of the bench-step device, with a portion of the step platform lying above the bench-step device.

The bench-step 10 of the present invention may be adjusted to any one of three vertical heights by varying the position of the L-shaped stop 32 as demonstrated in FIGS. 4–6. Referring now to FIG. 4, the bench-step 10 is shown positioned at its lowest vertical height. This lowest vertical height setting is obtained when each of the rests 32 is in a non-use position between each of the inner restraining stop 34 and the outer restraining stop 36. The support 32, when positioned as shown in FIG. 4, permits upper platform 14 to be inserted into the base 12 as shown. In this lowest position, transverse support platform wall 28 rests upon the base floor 16. The upper ledge 42 of rest 32 does not make contact with the underside of support surface 14.

Referring now to FIG. 5, the bench-step 10 may be adjusted to a second or intermediate vertical height. This intermediate height is obtained by slidably inserting each support 32 into the space between transverse base wall 20 and outer restraining stop 36, such that lower ledge 44 is positioned closer to transverse base wall 20 than is upper ledge 42. The upper platform is then inserted into base 12. Upper platform walls 28 of upper 14 will then rest upon lower edge 44 or L-shaped support 32.

Referring now to FIG. 6, the bench-step 10 may be adjusted to a third or uppermost position. This uppermost position is obtained by slidably inserting L-shaped support 32 into the space between the transverse base wall 20 and the outer restraining stop 36. L-shaped support 32 is positioned such that upper ledge 42 is positioned closer to transverse base wall 20 than is lower ledge 44. Upper platform 14 is then inserted into base 12, enabling upper platform wall 28 of upper 14 to rest upon the upper ledge 42 of support 32.

The area between the inner two restraining stops 36 may be used for storage both during use and transportation of the device 10. In operation the user is free to choose the desired vertical height adjustment in accordance with the exercise program.

The present invention provides an exercise device in which the vertical height ma be easily adjusted to increase the difficulty of the exercise, yet is simple in structure, easy to operate and contains ample storage space. Even though the structure is simple and lightweight, the present invention is both durable and sturdy. The present invention is approachable from any axis, thus decreasing the chances of an accident occurring during operation.

It should be understood that various modifications of the preferred embodiments of this invention, as discussed herein, can be made without departing from the spirit and scope of the invention.

What is claimed is:

1. An adjustable bench-step for use in benching, comprising:

a base with upwardly extending walls around the perimeter;

a manually movable platform nestable within said base, including a downwardly extending apron having a horizontal engaging surface; and means for supporting said platform from said base at a plurality of different heights, said supporting means including at least one spacer manually mountable in different positions on said base, said spacer also having one or more upwardly facing horizontal support surfaces each adapted to mate with at least a portion of said horizontal engaging surface of said apron when said spacer is mounted on said base, with a portion of at least one of said horizontal support surfaces contacting at least a portion of said horizontal engaging surface of said apron along said wall to support said platform at one of said different heights.

2. The adjustable bench-step of claim 1, wherein said base includes a storage compartment, said storage compartment being located in a spacer relation from each of said supporting means and said platform engaging surface.

3. The adjustable bench-step of claim 1, wherein said spacers are vertical spacers and said supporting means further horizontal support members between which said vertical spacers are slidably received, said horizontal support members being affixed to said base, and said vertical spacers adapted to mate with said horizontal engaging surface of said apron.

4. The adjustable bench-step of claim 1, wherein said horizontal engaging surface of said apron is snugly received within said base.

5. The adjustable bench-step of claim 1, wherein one of said different positions of said spacer includes a non-use position spaced from said walls of said base, whereby said spacer does not support said platform.

* * * * *